US008813632B2

(12) United States Patent
Adams

(10) Patent No.: US 8,813,632 B2
(45) Date of Patent: Aug. 26, 2014

(54) ADJUSTABLE FIREARM GAS BLOCK

(76) Inventor: Jason Mark Adams, Palm Harbor, FL (US)

( * ) Notice: Subject to any disclaimer, the term of this patent is extended or adjusted under 35 U.S.C. 154(b) by 210 days.

(21) Appl. No.: 13/553,216

(22) Filed: Jul. 19, 2012

(65) Prior Publication Data

US 2014/0076149 A1 Mar. 20, 2014

Related U.S. Application Data

(60) Provisional application No. 61/509,533, filed on Jul. 19, 2011.

(51) Int. Cl.
*F41A 5/18* (2006.01)
*F41A 5/28* (2006.01)

(52) U.S. Cl.
CPC ..... *F41A 5/28* (2013.01)
USPC ..... 89/192; 89/191.01; 89/193

(58) Field of Classification Search
CPC ..... F41A 5/28; F41A 5/26
USPC ..... 89/192, 191.02, 193
See application file for complete search history.

(56) References Cited

U.S. PATENT DOCUMENTS 1,431,059 A * 10/1922 Sutter ..... 89/193
2,003,066 A * 5/1935 Brondby ..... 89/193
2,058,897 A * 10/1936 Marek ..... 89/193
2,462,119 A * 2/1949 Moore ..... 89/193
3,036,501 A * 5/1962 Wild ..... 89/193
3,333,509 A * 8/1967 Muhlemann ..... 89/193
3,893,370 A * 7/1975 Hutton et al. ..... 89/193
4,702,146 A * 10/1987 Ikeda et al. ..... 89/193
7,469,624 B1 12/2008 Adams
7,610,844 B2 * 11/2009 Kuczynko et al. ..... 89/193
7,856,917 B2 12/2010 Noveske
8,393,259 B2 * 3/2013 Larue ..... 89/193
8,596,185 B1 * 12/2013 Soong et al. ..... 89/193
8,701,543 B2 * 4/2014 Brinkmeyer et al. ..... 89/193
2009/0229454 A1 * 9/2009 Fluhr et al. ..... 89/193
2010/0218671 A1 9/2010 Mayberry
2012/0167756 A1 * 7/2012 Larue ..... 89/193
2013/0025445 A1 * 1/2013 Windauer ..... 89/193
2013/0098235 A1 * 4/2013 Reinken ..... 89/193
2013/0174721 A1 * 7/2013 Langevin et al. ..... 89/193
2014/0076150 A1 * 3/2014 Brinkmeyer et al. ..... 89/193

* cited by examiner

*Primary Examiner* — Michelle R Clement
(74) *Attorney, Agent, or Firm* — Lauson & Tarver LLP; Edwin P. Tarver

(57) ABSTRACT

An adjustable firearm gas block has a gas channel intersected by a threaded bore. A set screw with longitudinal slots is driven through the bore until it enters and constricts the gas channel. A second bore, parallel to the first bore, is connected to the first bore by a passage. A spring and a detent plunger having a slanted notch are inserted in the second bore with a bearing located in the slanted notch and passage. When the detent plunger is in a resting position, it presses the bearing into a longitudinal slot, preventing the set screw from turning. When the detent plunger is urged away from the resting position, the bearing disengages the longitudinal slot, traveling into the slanted notch and allowing the set screw to rotate, thereby adjusting the gas pressure emitted by the gas block.

12 Claims, 3 Drawing Sheets

ADJUSTABLE FIREARM GAS BLOCK

This application claims the benefit of the filing date of provisional application No. 61/509,533, filed on Jul. 19, 2011.

BACKGROUND

Firearm gas blocks channel a portion of the pressurized gas behind a fired bullet, redirecting it up and back along the barrel through an associated gas tube. Pressurized gas coming from the gas tube causes a bolt carrier to expel the used bullet casing, cock the hammer and load the next bullet for firing. High pressure ammunition, oversized gas ports, and silencers can cause excessive recoil, particularly in AR15/M16 rifle platforms.

An effective way to reduce rifle recoil is to reduce the velocity of the bolt carrier by reducing the volume of gas flowing through the gas block. Existing gas blocks have a variety of drawbacks. They must be custom ordered to fit specific barrel lengths, are difficult to adjust in the field, and have a limited number of settings (i.e., on or off). An adjustable gas block is therefore needed which fits a variety of barrel lengths, is easily adjustable in the field, and which has a large variety of pressure settings.

SUMMARY

An adjustable gas block for firearms is designed to accommodate a variety of firearm barrels. The gas block has a gas channel and at least one anchoring bore, preferably on the bottom of the gas block. The anchoring bore accommodates one or more anchoring pins which, when installed, engage anchoring points on the barrel to hold the gas block in position. When properly positioned, the gas channel of the gas block aligns with the gas port on the barrel.

A threaded first bore in the gas block intersects the gas channel. A set screw with longitudinal slots along its length is installed in the first bore. By traveling through the first bore and entering the gas channel, the set screw constricts the gas channel. Preferably, the set screw can travel completely into and close off the gas channel. A second bore adjacent to the first bore houses a detent plunger. The detent plunger has a slanted notch sized to accommodate a bearing, and is biased to a resting position in the bore, preferably by a spring.

A passage connects the first bore and the second bore and the bearing is positioned in the passage. Preferably the passage is part of a bearing access bore extending transversely through the second bore and into the first bore. The bearing access bore facilitates introduction of the bearing into the gas block. When the detent plunger is in the resting position, the slanted notch urges the bearing through the passage and into one of the longitudinal slots on the set screw, preventing it from turning. Preferably, the screw has four longitudinal slots capable of receiving the bearing, and the longitudinal slots are located between two threaded portions of the set screw.

The gas channel leads to a gas tube which is held in place using a gas tube retaining pin. A gas tube retaining bore in the gas block, transverse to the gas channel, aligns with the gas tube to accept and retain the gas tube retaining pin. In this manner, exhaust gasses from firing are transmitted from the firearm barrel, through the gas channel, regulated by the set screw, and to the gas tube.

To manufacture the gas block, the anchoring bores, gas channel and gas tube retaining pin bores are formed (e.g., by drilling). The first bore for housing the set screw and second bore for housing the detent plunger are also formed. The bearing access bore is then formed through the second bore and into the first bore, creating a passage between the first and second bores and access for the installing the bearing.

With the first and second bores formed, the set screw is installed in the first bore. The bearing is then introduced into the bearing access bore. The bearing is urged toward the set screw until it enters the passage between the first bore and second bore. The detent plunger is then introduced into the second bore, preferably preceded by the spring. In an alternate embodiment, the set screw may be installed after installation of the bearing and detent plunger.

To operate the gas block, a user installs it on a firearm by sliding it over the firearm barrel until the barrel gas port aligns with the gas channel, and the anchoring bores align with anchoring points on the barrel. The anchoring pins are then installed to hold the gas block in position. To change the gas pressure of the firearm, a user depresses the detent plunger and rotates the set screw, thereby increasing or decreasing the amount of the set screw entering the gas channel, and altering the gas volume.

DESCRIPTION

Figure 1:
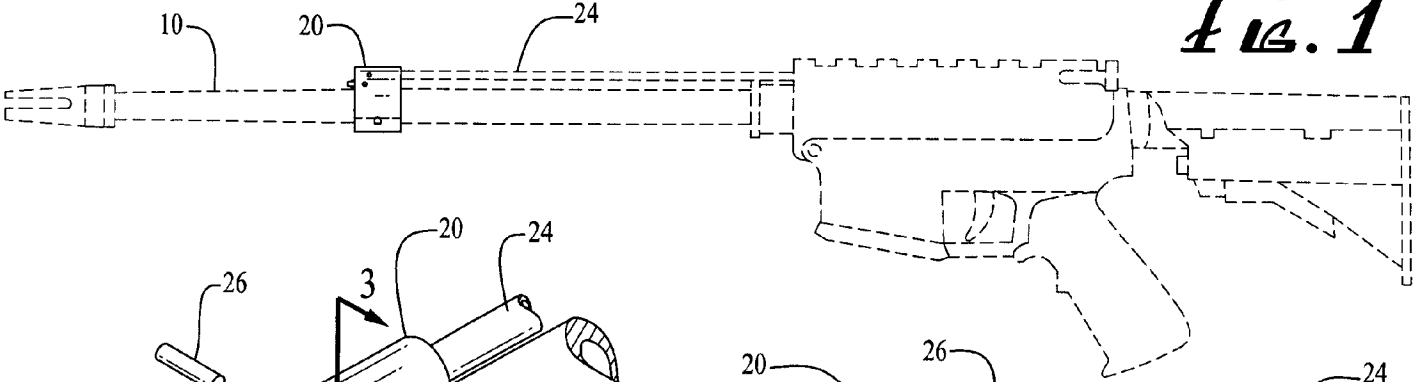
FIG. 1 is a side view of a gas block installed on a firearm barrel.
Figure 2:
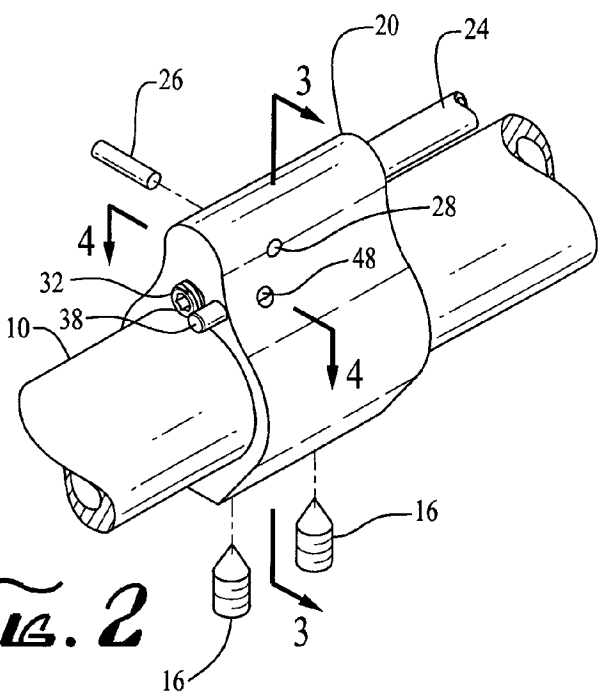
FIG. 2 is a perspective view of a gas block installed on a firearm barrel.
Figure 3:
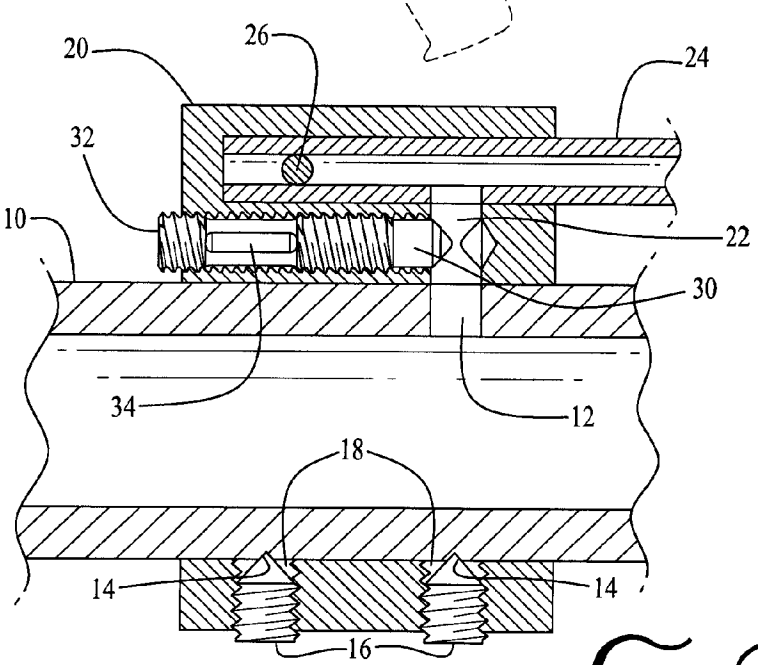
FIG. 3 is a section view of a gas block installed on a firearm barrel.

Referring to FIGS. 1-3, a gas block 20 connects to a conventional firearm barrel 10 and gas tube 24. The gas block 20 encircles the barrel 10 at a predetermined position, covering gas port 12. The barrel 10 includes anchoring points 14 to preserve the position of the gas block 20 as the firearm is fired. The anchoring points 14 align with anchoring pins 16 driven into anchoring bores 18 on the underside of the gas block 20. The anchoring pins 16 prevent both sliding and rotational movement of the gas block relative to the barrel 10.

The gas block 20 has a gas channel 22 which aligns with the gas port 12. In one embodiment, the gas channel 22 directs gasses exiting the gas port 12 up and back along the barrel 10. To capture gasses exiting the barrel 10, a gas tube 24 fits into the gas block 20. The gas tube 24 is anchored in position by a gas tube retaining pin 26, which inserts through a gas tube retaining pin bore 28 on the gas block 20.

The volume of expelled gas is controlled through a threaded first bore 30 housing a set screw 32 intersecting the gas channel 22. Rotating the set screw 32 urges it into the gas channel 22, constricting it, and reducing the flow of gasses expelled when firing. The set screw 32 has longitudinal slots 34 disposed along its length. The longitudinal slots 34 are used to control rotation of the set screw 32.

Figure 4:
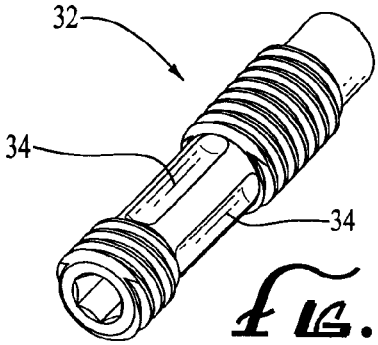
FIG. 4 is a perspective view of a set screw.
Figure 5:
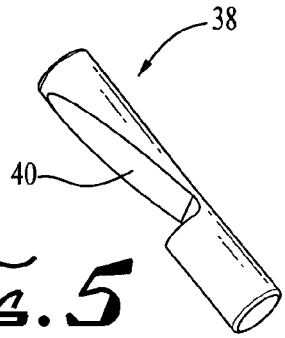
FIG. 5 is a perspective view of a detent plunger.
Figure 9:
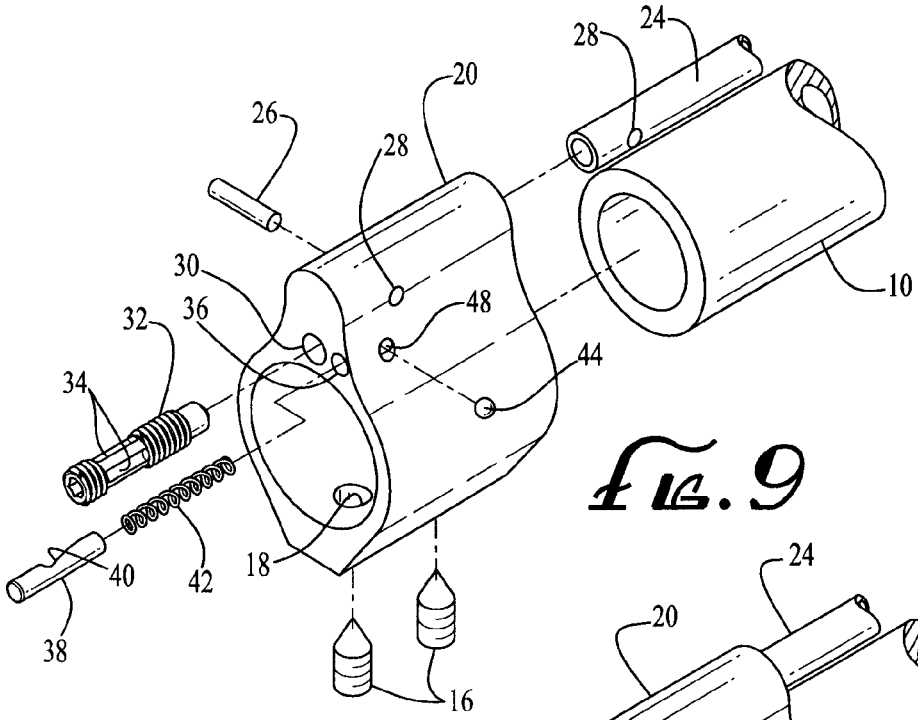
FIG. 9 is an exploded perspective view of a gas block, barrel and gas tube.
Figure 10:
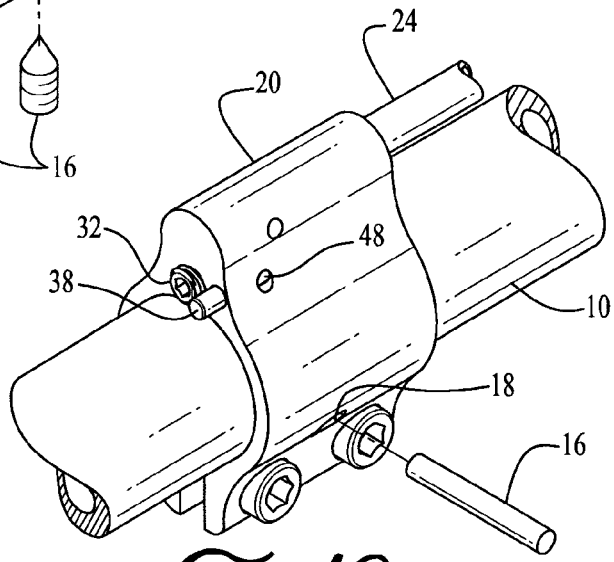
FIG. 10 is a perspective view of a gas block having an alternative anchoring mechanism.

Referring to FIGS. 4 and 5, the set screw 32 and detent plunger 38 are shown. The longitudinal slots 34 of the set screw 32 interact with a ball bearing 44 (shown in FIGS. 6-8). Once the detent plunger 38 is depressed, the slanted notch 40 provides clearance to permit the bearing 44 to move away from the set screw 32. The longitudinal slots 34 are shaped so that when the set screw 32 is turned, the bearing 44 can ride over the circumference of the set screw 32 without catching on the longitudinal slots 34, much like a cam.

Figure 6:
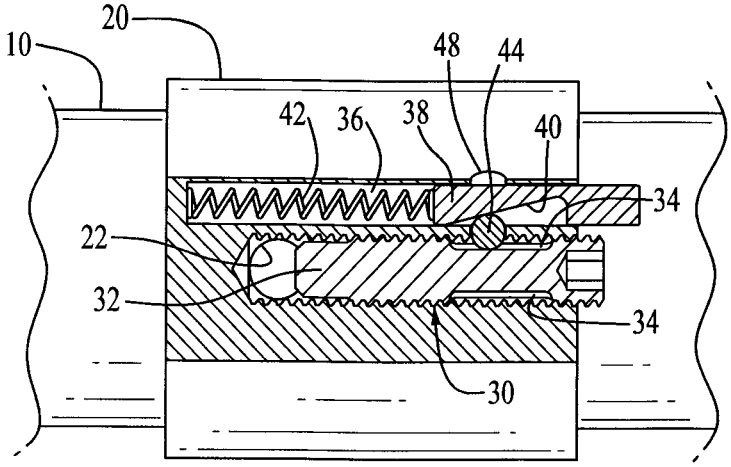
FIG. 6 is a section view of a gas block with the set screw adjusted for greater gas flow into a gas tube.
Figure 7:
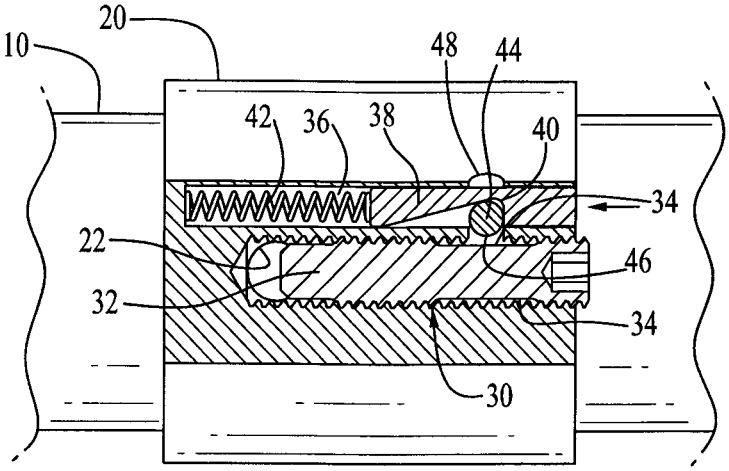
FIG. 7 is a section view of a gas block with the detent plunger depressed for changing the position of the set screw.
Figure 8:
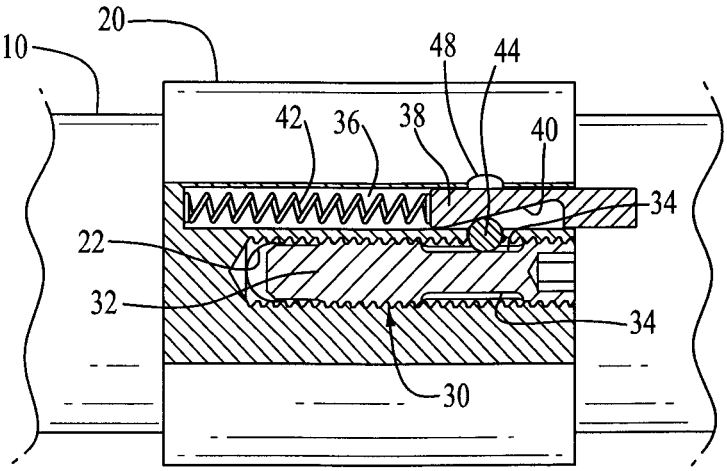
FIG. 8 is a section view of a gas block with the set screw adjusted for lesser gas flow into a gas tube.

Referring to FIGS. 6-8, rotational control of the set screw 32 is accomplished through a second bore 36 housing a detent plunger 38. The detent plunger 38 has a slanted notch 40, and is biased to a resting position by a spring 42. A bearing 44 is retained in the slanted notch 40. The bearing 44 interfaces with the set screw 32 through a passage 46 between the first bore 30 and second bore 36. The passage 46 preferably incorporates a bearing access bore 48, which facilitates assembly of the gas block 20 by providing a point of entry for the bearing 44.

As shown in FIG. 4, when the detent plunger 38 is in a resting position, the slanted notch 40 urges the bearing 44 through the passage 46 to engage one of the longitudinal slots 34, preventing the set screw 23 from rotational movement. As shown in FIG. 5, in order to rotate the set screw 23 to a different pressure setting, i.e., to constrict the gas channel 22, a user depresses the detent plunger 38. As the detent plunger 38 is urged forward compressing the spring 42, the slanted notch 40 allows the bearing 44 to travel through the passage 46, disengaging the longitudinal slot 34 and allowing the set screw 23 to rotate. Releasing the detent plunger 38 causes the slanted notch 40 to force the bearing 44 back through the passage 46 to engage a longitudinal slot 34 on the set screw 23 as shown in FIG. 6.

Referring to FIG. 7, an exploded view of the barrel 10, gas block 20, and gas tube 24 are shown. In this view the set screw 23 has four longitudinal slots 34 disposed around its circumference, and the longitudinal slots 34 are located between two sets of threads. Referring to FIG. 8, an alternative anchoring method is shown. In this embodiment, the anchoring pin 16 is inserted into an anchoring bore 18 transverse to the barrel 10 to engage a lateral slot (not shown) in the bottom of the barrel 10.

The gas block 20 apparatus having been shown and described, manufacture and use of the gas block 20 will now be discussed.

The gas block 20 may be machined from a solid starting material, preferably metal. Once the gas block 20 is formed (e.g., drilled) to accommodate the barrel 10, the anchoring bores 18 at the bottom of the gas block 20 and gas tube retaining pin bore 28 are be formed. The threaded first bore 30, second bore 36 and bearing access bore 48, including the passage 46, are also formed.

The set screw 32 is installed in the first bore 30 and the bearing 44 inserted into the passage 46 via the bearing access bore 48. To hold the bearing 44 in place, the spring 42 and detent plunger 38 are installed in the second bore 36 with the slanted notch 40 facing the bearing 44. During installation, it is anticipated the set screw 32 may be inserted only partially to allow the bearing 44 to clear the second bore 36, and permit installation of the spring 42 and detent plunger 38. The set screw 32 may then be driven completely into the first bore 30 urging the bearing 44 into the slanted notch 40 of the detent plunger 38.

To operate the gas block 20, a user installs the gas block 20 around a firearm barrel 10, bringing it adjacent a gas port 12 and anchoring points 14. The user then installs the anchoring pins 16 in the anchoring bores 18 so that the gas port 12 is aligned with the gas channel 22. A gas tube 24 is then inserted into the gas block 20 and a gas tube retaining pin 26 inserted through the gas tube retaining pin bore 30.

With the gas block 20 installed, the user may then urge the detent plunger 38 away from its biased position and rotate the set screw 32, causing the set screw to constrict the gas channel to a desired setting. Releasing the detent plunger 38 and optionally rotating the set screw until the bearing reseats in a longitudinal slot 34 sets the gas volume permitted through the gas block 20.

While the apparatus and method have been described in detail with reference to specific embodiments thereof, it will be apparent to one skilled in the art that various changes and modifications can be made therein without departing from the spirit and scope thereof. Thus, it is intended that the present description cover the modifications and variations of the apparatus and method provided they come within the scope of the appended claims and their equivalents.

What is claimed is:

1. An adjustable firearm gas block having a gas channel, comprising:

a threaded first bore intersecting the gas channel;

a set screw in the first bore having longitudinal slots, the set screw adapted to constrict the gas channel;

a second bore adjacent to the first bore;

a detent plunger in the second bore biased to a resting position; and a bearing in a passage between the first bore and the second bore, wherein the detent plunger in the resting position holds the bearing in a longitudinal slot preventing the set screw from turning, and wherein urging the detent plunger away from the resting position allows the bearing to disengage the longitudinal slot, thereby allowing the set screw to turn, adjusting gas pressure in the gas channel caused by firing.

2. The gas block of claim 1 wherein a gas tube retaining pin bore transverse to the gas channel aligns with a gas tube to receive a gas tube retaining pin.

3. The gas block of claim 1 wherein the set screw completely closes the gas channel.

4. The gas block of claim 1 wherein the set screw has four longitudinal slots.

5. The gas block of claim 1 wherein the longitudinal slots are disposed between threaded portions of the set screw.

6. The gas block of claim 1 wherein the detent plunger includes a slanted notch for accommodating the bearing.

7. The gas block of claim 1 wherein the detent plunger is biased by a spring.

8. The gas block of claim 1 wherein the passage comprises a bearing access bore for introducing the bearing during manufacture.

9. The gas block of claim 8 wherein the bearing access bore extends transversely through the second bore and into the first bore.

10. The gas block of claim 1 having an anchoring bore on the bottom of the gas block for accommodating an anchoring pin.

11. The gas block of claim 10 wherein the anchoring pin engages an anchoring point on the bottom of a barrel.

12. An adjustable firearm gas block having a gas channel, comprising:

a threaded first bore intersecting the gas channel;

a set screw in the first bore having four longitudinal slots disposed between two threaded sections of the set screw adapted to constrict the gas channel;

a second bore adjacent to the first bore;

a detent plunger in the second bore having a slanted notch, the detent plunger biased to a resting position; and a bearing in a passage between the first bore and the second bore, wherein the detent plunger in the resting position holds the bearing in a longitudinal slot preventing the set screw from turning, and wherein urging the detent plunger away from the resting position allows the bearing to disengage the longitudinal slot, thereby allowing the set screw to turn, adjusting gas pressure in the gas channel caused by firing.

* * * * *